US009957786B2

(12) United States Patent
Allen et al.

(10) Patent No.: US 9,957,786 B2
(45) Date of Patent: May 1, 2018

(54) MULTI-ZONE COMPLETION ASSEMBLY INSTALLATION AND TESTING

(71) Applicants: Jason A. Allen, Houston, TX (US); Aaron C. Hammer, Houston, TX (US); Robert S. O'Brien, Katy, TX (US)

(72) Inventors: Jason A. Allen, Houston, TX (US); Aaron C. Hammer, Houston, TX (US); Robert S. O'Brien, Katy, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 374 days.

(21) Appl. No.: 14/505,010

(22) Filed: Oct. 2, 2014

(65) Prior Publication Data

US 2016/0097267 A1 Apr. 7, 2016

(51) Int. Cl.

| | |
|---|---|
| ***E21B 43/14*** | (2006.01) |
| ***E21B 34/14*** | (2006.01) |
| ***E21B 43/12*** | (2006.01) |
| ***E21B 47/10*** | (2012.01) |

(52) U.S. Cl.

CPC ..... *E21B 43/14* (2013.01); *E21B 34/14* (2013.01); *E21B 43/12* (2013.01); *E21B 47/1025* (2013.01)

(58) Field of Classification Search

CPC ..... E21B 34/14; E21B 34/12; E21B 43/12; E21B 43/14; E21B 47/1025

See application file for complete search history.

(56) References Cited

U.S. PATENT DOCUMENTS

| | | | | |
|---|---|---|---|---|
| 7,543,647 | B2 | 6/2009 | Walker | |
| 2007/0084605 | A1* | 4/2007 | Walker | E21B 23/006 166/313 |
| 2015/0047837 | A1* | 2/2015 | Turner | E21B 43/14 166/254.2 |

* cited by examiner

*Primary Examiner* — Caroline N Butcher

(74) *Attorney, Agent, or Firm* — Cantor Colburn LLP

(57) ABSTRACT

A method of deploying a multi-zone completion assembly in a wellbore is disclosed. The method includes: placing an outer assembly below a surface location, wherein the outer assembly includes an activation device. The method further includes placing an inner assembly in the outer assembly, the inner assembly including a lower opening tool spaced from an upper opening tool. The method further includes activating the lower opening tool using the activation device The method further includes activating the upper opening tool independent of the lower opening tool using the activation device.

22 Claims, 4 Drawing Sheets

MULTI-ZONE COMPLETION ASSEMBLY INSTALLATION AND TESTING

BACKGROUND

1. Field of the Disclosure

This disclosure relates generally to apparatus and methods for completing a multi-zone wellbore for the production of hydrocarbons from subsurface formations, including fracturing, sand packing and flooding the zones.

2. Background of the Art

In wellbores that include multiple production zones, a multi-zone completion assembly that includes an outer multi-zone assembly (hereinafter the outer assembly or string) with an inner assembly inside the outer assembly are used in the wellbore for fracturing and gravel packing (frac/packing) of each zone before producing the hydrocarbons (oil and gas) from such zones. The outer assembly typically includes a top packer, a bottom packer and an isolation packer for each zone. To treat a particular zone, such zone is isolated from other zones by setting the packers. A cross-over (also referred to as frac port) in the inner assembly is aligned with a flow port (also referred to as a "frac sleeve") in the outer assembly. A treatment fluid (typically a mixture of water, proppant and additives) is supplied under pressure into the inner string, which treatment fluid flows form the frac port to the formation via the flow port. Some multi-zone completion assemblies may include 5 or more spaced apart sections, each section exceeding 500 feet in length and several hundred feet apart.

The disclosure herein provides a method and tools to assemble and test a multi-zone outer completion assembly on the rig floor and running of multiple deactivated opening or shifting tools on an inner assembly through the outer assembly and then activating such tools once such tools reach a specific location in the outer assembly before placing the outer assembly with the inner assembly therein in the wellbore for performing any treatment operations.

SUMMARY

In one aspect, a method of deploying a multi-zone completion assembly in a wellbore is disclosed. In one non-limiting embodiment, the method includes: placing an outer assembly below a surface location, wherein the outer assembly includes an activation device; placing an inner assembly in the outer assembly, the inner assembly including a lower opening tool spaced from an upper opening tool; activating the lower opening tool using the activation device; and activating the upper opening tool independent of the lower opening tool using the activation device.

In another aspect, a multi-zone completion assembly is disclosed that in one embodiment includes: an outer assembly for placement in a wellbore; and an inner assembly for placement in the outer assembly, wherein: the outer assembly includes an activation device; the inner assembly includes a lower opening tool spaced from an upper opening tool; and wherein the lower opening tool is activated from a deactivated position using the activation device and the upper opening tool is activated from a deactivated position independently of the activation of the lower opening tool using the activation device.

Examples of the more important features of a well completion system and methods have been summarized rather broadly in order that the detailed description thereof that follows may be better understood, and in order that the contributions to the art may be appreciated. There are, of course, additional features that will be described hereinafter and which will form the subject of the claims.

BRIEF DESCRIPTION OF THE DRAWINGS

For a detailed understanding of the apparatus and methods disclosed herein, reference should be made to the accompanying drawings and the detailed description thereof, wherein like elements are generally represented by same numerals and wherein.

DETAILED DESCRIPTION OF THE DRAWINGS

Figure 1:
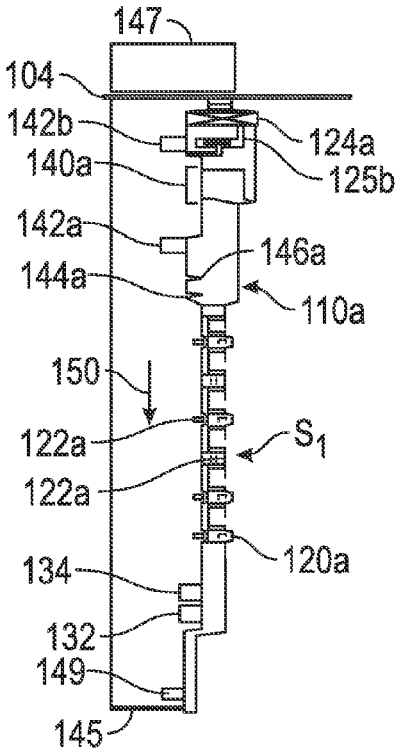
FIG. 1 shows a lowermost section of an outer assembly hung from a rig floor for testing such section.
Figure 2:
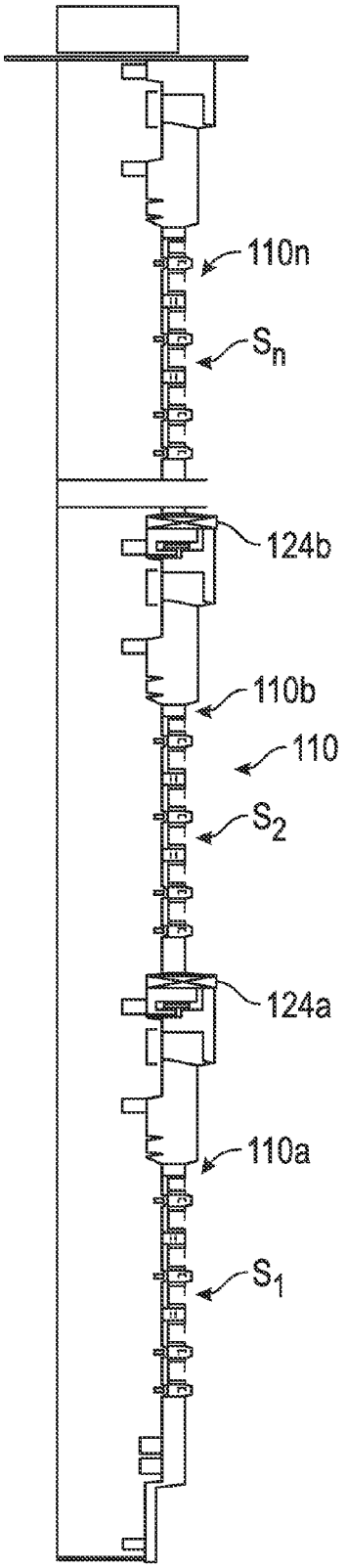
FIG. 2 shows all sections of an outer string hung from the rig floor for testing each section of the outer string.

FIGS. 1 and 2 show placement (or deployment) of an outer assembly (or outer string) of a completion assembly into a wellbore from a rig floor 104. In one aspect, the rig may be an offshore rig wherein a riser runs from the rig to the top of a wellbore formed from the sea floor. In another aspect, the wellbore may be drilled from an earth surface. The wellbore is a multi-zone well that has been configured for treatment of and production from a number of zones. The outer assembly includes serially connected multiple sections, each section including a number of devices, such as packers, sand screen, fluid flow devices and devices or profiles that interact with a service assembly for performing various downhole operations. The outer assembly is permanently placed in the wellbore. In general, each outer assembly section is assembled at the surface, sequentially placed or hung from the rig floor inside the riser or the wellbore, as the case may be, and pressure tested to ensure that various flow devices in each such section are operating correctly. Once the outer string has been assembled and tested, service assembly (also referred to as the "inner assembly") is placed inside the outer assembly to perform a variety of operations relating to the various devices in the outer assembly for treatment of the zones.

FIG. 1 shows placement of the first or lowermost section 110*a* from the rig floor 104 into a riser or wellbore. The section 110*a* includes a sand screen S1 that includes a fluid flow device or port, such as a sliding sleeve valve and other flow devices generally denoted as 122*a*. An isolation packer 124*a* above screen S1 is used to isolate the first section 110*a* from other sections, as described later in reference to FIG. 2. A packer activation device 125*a* is provides to activate or set the packer 124*a* inside the well. A fluid flow device (referred to herein as 'frac sleeve') 140*a*, such as a sliding sleeve valve, when open allows a treatment fluid to flow from inside the section 110*a* to a zone in the formation. The section 110*a* further includes an activation device or profile 132 and an opening tool test device or profile 134 above the activation device, each such device configured to interact with an opening tool, described later in reference to FIGS.

3-5. A plug 145 below the screen S1 is provided to block fluid flow past the plug. A test plug 147 is placed at the surface to facilitate pressure testing of the section 110*a*. In aspects, the plug 145 may be configured to break when pushed downward or to move it from a closed position to an open position. The plug 145 may then be closed at a later time. A seal 149 may be provided below or above the activation device 132 for sealing an inner assembly to the outer assembly 110*a* as described in reference to FIG. 7. Seals, such as inverted seals 142*a* and 142*b*, are provided to seal an area around the frac sleeve 140*a* between the outer section 110*a* and the inner string (described later). In addition, the section 110*a* includes a locating profile 146*a* for locating that position on the section 110*a* and a set down profile 144*a* for setting the inner assembly to perform a treatment operation. The first section 110*a* is assembled with the screen S1, flow devices 120*a*, 122*a*, 140*a*, activation and test devices 132, 134, and the plug 145. All flow devices are installed in the section 110*a* in their closed position. The section 110*a* is then run into the riser or the wellbore and hung from the rig floor 104. A fluid 150 under pressure is supplied into the section 110*a* to determine presence of any leaks. No pressure drop at the surface indicates that all flow devices in section 110*a* are in their respective closed positions, while a drop in pressure indicates a leak.

Referring to FIG. 2, once the lowermost section 110*a* has been pressure tested, a second or next upper section 110*b* is installed above the section 110*a*. The section 110*b* includes the components and devices described in reference to section 110*a*, except section 110*b* does not include the activation profile 132 or the test device 134. The second section 110*b* is then pressure tested. Similarly, all other sections (through 110*n*), each corresponding to a zone, are sequentially placed above the previously placed section and pressure tested. FIG. 2 shows the entire outer assembly 110 assembled and hung from the rig floor 104, wherein each section 110*a*-110*n* has been pressure tested and wherein all flow devices in the outer assembly 110 are in their respective closed positions.

Figure 3:
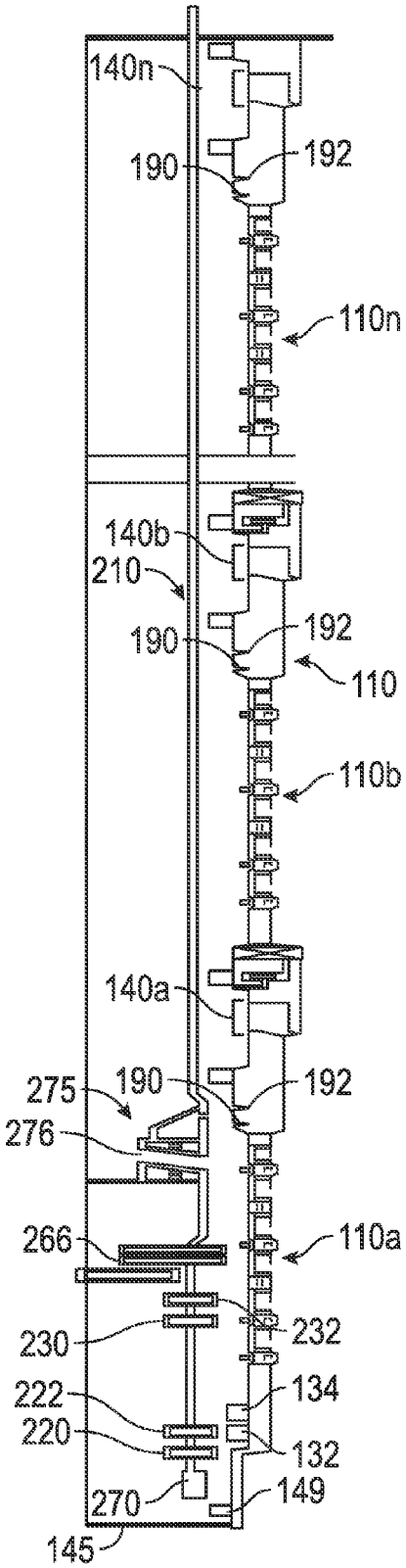
FIG. 3 shows initial placement of an inner assembly inside the outer assembly shown in FIG. 2 while the outer assembly is hung from the rig floor.

Referring to FIG. 3, once all sections 110*a*-110*n* of the outer assembly 110 have been assembled and tested, an inner assembly 210 (also referred to as the "service assembly" or the "inner assembly") is run inside the outer assembly 110. In aspects, the inner assembly 210 includes a lower opening tool 220 spaced apart from an upper opening tool 230, wherein each opening tool is configured to open one or more devices in the outer string 110. Additional spaced apart opening tools may also be provided. The inner assembly 210 further includes a lower closing tool 222 and an upper closing tool 232, each configured to close one or more devices in the outer assembly 110. The inner assembly also includes a set down tool 266 to set the inner assembly 210 in the outer assembly 110 at a setting profile 190 at each section of the outer assembly. The inner assembly further includes an up-strain locating device 268 to locate a profile 192 in each of the sections 110*a*-110*n*. The inner assembly 220 further may include a mandrel 270, such as slick line at the bottom end of the inner string 220 to provide a seal between the inner assembly 210 and the seal 149 on the outer assembly 110 as described in reference to FIG. 7. The inner string also includes a cross-over port (also referred to as the "frac-port") 275 having a flow path 276 to supply a fluid from the inner assembly 201 to each of the frac sleeves 140*a*-140*n*, The inner string 210 is run in the outer assembly 110 until the lower opening tool 220 is at or below the activation device 132 as shown in FIG. 3, while the mandrel 270 remains above the plug 145.

In one non-limiting embodiment, each opening tool 220 and 230 includes a shifting collet that is initially collapsed to a diameter less than the diameter needed to engage any corresponding profiles in the outer assembly 110. In one configuration, the shifting collet is collapsed by a sleeve installed over the shifting collet. The sleeve may be a part of a mechanism (sleeve mechanism) that includes a shear pin or shear screw that prevents the shifting collet from moving axially. In one aspect, the sleeve mechanism can only transmit load onto the shear pin in one direction. This sleeve mechanism engages with the opening tool activation profile 132 (FIG. 1) in the uphole direction only, such that after the sleeve mechanism passes the activation profile 132, movement of the sleeve mechanism in the reverse direction (uphole) will cause the sleeve mechanism to engage the activation profile 132, allowing force to be transferred to the shear pin holding the sleeve in place over the collet. Any other type of an opening tool available in the art, including one containing dogs, may be utilized for the purpose of this disclosure. Such tools and mechanisms are known in the art and are thus not described in detail herein.

In one non-limiting embodiment, the testing device 134 includes a sliding sleeve with a collet engaged in a detent in a sliding sleeve housing. This collet creates a mechanical force which holds the sliding sleeve in place until sufficient force has been generated to snap the collet out of the detent. To test the opening tool 220 or 230, the shifting collet on the opening tool is positioned above the sliding sleeve of device 132 and then moved downward to engage the collet in the sliding sleeve. Once the collet engages the sliding sleeve, the inner assembly 220 will stop moving until the collet snap force on the sliding sleeve has exceeded a threshold. At this point, the inner assembly 210 continues to move down and the shifting collet disengages from the sliding sleeve. After the shifting collet has disengaged from the sliding sleeve, a spring resets the sliding sleeve to its original position allowing it to function again. Such mechanisms are known in the art and are thus not described herein in detail. Any other device may be utilized as the opening tool with a corresponding activation device. In general, an increased amount of force is required to move the opening tool past the test device, which provides a verification indication or confirmation.

Figure 4:
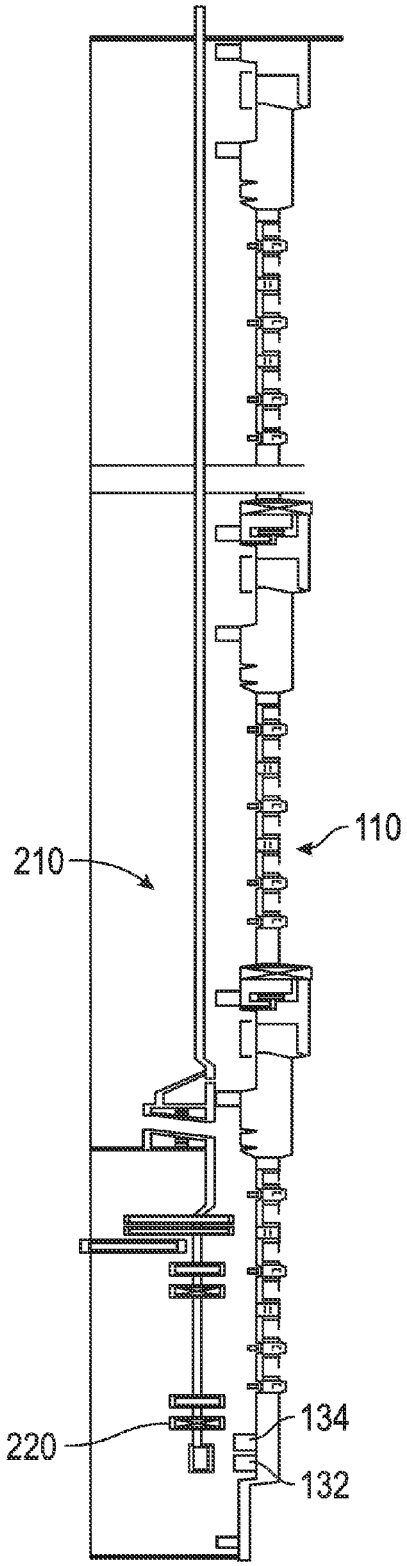
FIG. 4 and FIG. 5 show sequence of activating the lowermost opening or shifting tool in the inner string.
Figure 5:
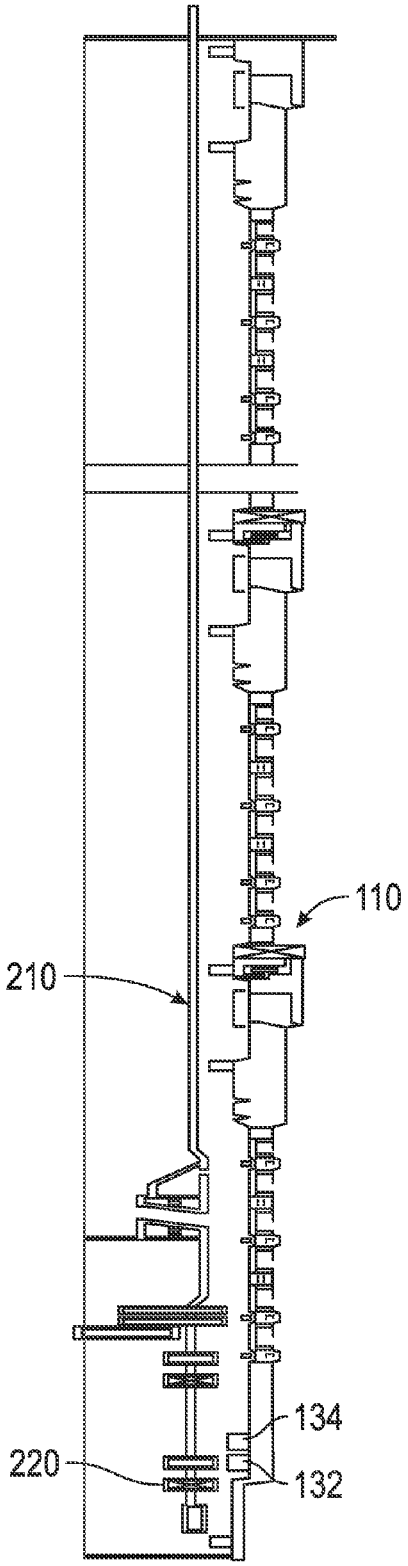

Until this point, the opening tools are disabled or deactivated. Prior to performing any treatment operation, the opening tools 220 and 230 are first activated from their deactivated positions. Referring to FIG. 3, to activate the lower opening tool 220, the inner assembly 210 is lowered to cause the lower opening tool 220 to pass the activation device 132. The inner assembly 210 is then picked up (moved uphole) to engage or interact with the lower opening tool 220 with the activation device 132. Moving uphole the opening tool 220 past the activation device 132 will require a force F1 that provides an indication to an operator that the opening tool has been activated. To confirm or verify that the opening tool 220 has been activated, the inner assembly 210 is moved uphole further to move the lower opening tool 220 past that testing or verification device 134 on the outer assembly 110 as shown in FIG. 4. Setting the opening tool 220 past the testing device 134 will cause the opening tool 220 to stop and then an increased force F2 downward will cause the opening tool 220 to continue to move downward with the opening tool activated, as shown in FIG. 5. At this stage, the lower opening tool 220 is confirmed as being activated. In aspects, the verification device is multi-acting and thus the verification process may be repeated.

Figure 6:
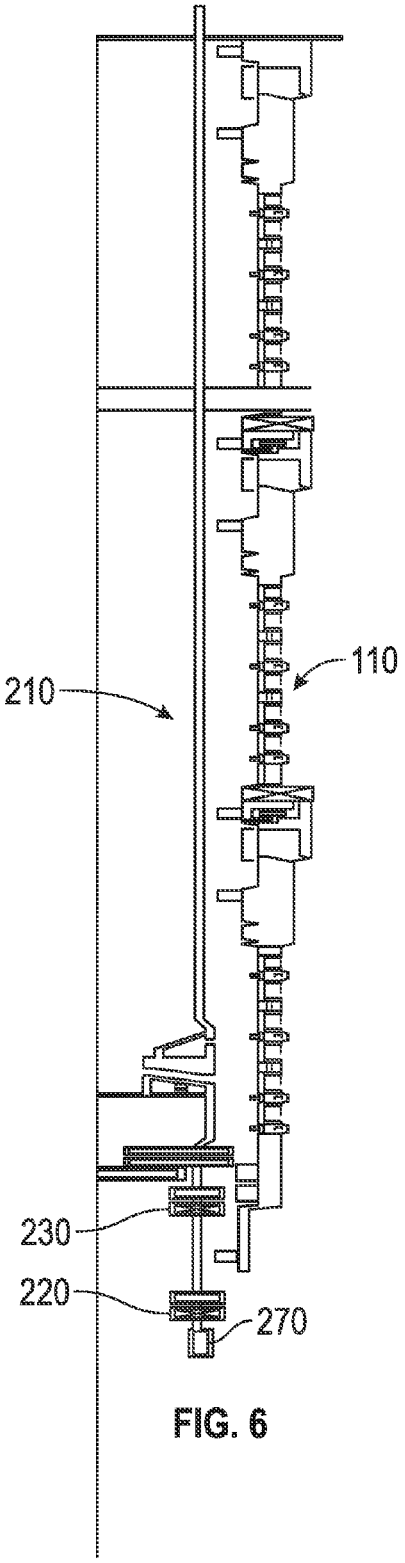
FIG. 6 and FIG. 7 show activation and of the upper opening tool.

To activate the upper opening tool 230, the inner assembly 110 is moved down to cause the device 270 at the bottom of the inner assembly 110 to remove or deactivate the plug 145 and to move the upper opening tool 230 past the activation device 132, as shown in FIG. 6. The upper opening tool 230 is then activated and such activation verified or confirmed, as described above in reference to the lower opening tool 220 and FIGS. 3-5. If the inner string 110 includes additional opening tools, such tools are activated in the manner described above in reference to the upper opening tool 230.

Figure 7:
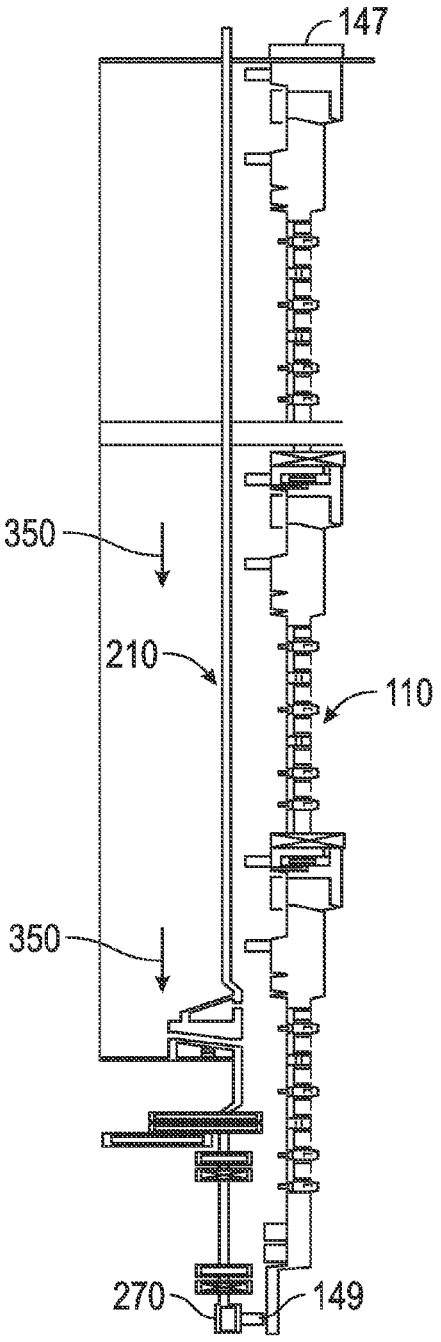
Figure 8:
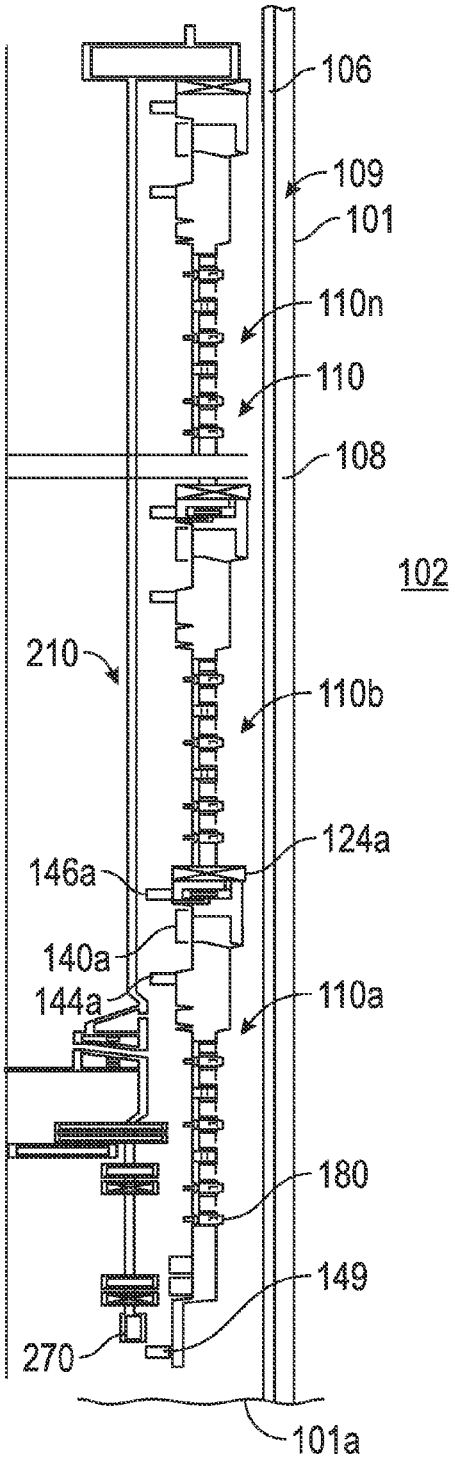
FIG. 8 shows the placement of the inner assembly inside the outer assembly placed in the wellbore, wherein a section in the outer string corresponds to a zone in the formation for treatment operations.

Referring to FIG. 7, after all the opening tools 220 and 230 have been activated and verified, the inner string 110 is moved uphole to reestablish a seal between the inner assembly 210 and the outer assembly 110, which may be accomplished by establishing a seal between a device, such as mandrel 270, on the inner assembly and seal 149 on the outer string 210, as shown in FIG. 7. At this stage, a fluid 350 may be supplied under pressure to the inner assembly 110 to pressure test the outer assembly 210 to ensure that all flow devices in the outer assembly 210 are closed. The inner assembly 110 is then moved uphole to disengage the seal between the mandrel 270 and seal 148 as shown in FIG. 8. This step enables the system to establish forward circulation path while running tools in the wellbore 101. The inner assembly 110 is now assembled or deployed in the outer assembly 210. The outer assembly 220, with the inner assembly 110 with the opening tools 220 and 230 activated may now be lowered into the wellbore 101. FIG. 8 shows the outer assembly 220 with the inner assembly 110 placed at the bottom 101*a* of the wellbore 101 formed in a formation 102. In a multi-zone wellbore, a casing 106 is placed in the wellbore 101 and cement 108 placed in the annulus between the casing 106 and the wellbore 101. Perforations 118*a*-118*n* corresponding to zones Z1-Zn establish fluid communication between each zone and the outside of the section 110*a*. Sections 110*a*-110*n* in the outer string 210 align with their corresponding zones Z1-Zn. Screen S1 is placed across from zone Z1, screen S2 from across zone Z2 and screen Sn from across from zone Zn. The wellbore 101 is now ready for treatment. To treat a particular zone, such as zone Z1, it is isolated from the other zones by setting packer 124*a*, frac sleeve 140*a* is opened and the frac port 275 aligned with the frac sleeve 140*a*. The area around the frac sleeve 140 between the inner assembly 210 and the outer assembly 110 is sealed with seals 144*a* and 146*a*. A treatment supplied into the inner string 110*a* will move to the zone Z1 via the frac port 275 and the frac sleeve 140*a*. Other zones may be treated in the manner described above. Depending upon the depth of the zones, the opening tools 220 and 230 may be several hundred feet apart. The lower opening tool 220 may be used to open ports, such as port 180 at or near the bottom of the screen while the upper opening tool 230 may be used to open the frac sleeve 140*a*. This avoids moving the entire inner assembly 210 great distances inside the outer string assembly 110 for performing downhole operations.

The foregoing disclosure is directed to the certain exemplary embodiments and methods of the present disclosure. Various modifications will be apparent to those skilled in the art. It is intended that all such modifications within the scope of the appended claims be embraced by the foregoing disclosure. The words "comprising" and "comprises" as used in the claims are to be interpreted to mean "including but not limited to". Also, the abstract is not to be used to limit the scope of the claims.

The invention claimed is:

1. A method of deploying a multi-zone completion assembly in a wellbore, the method comprising:

placing an outer assembly below a surface location, wherein the outer assembly includes an activation profile;

placing an inner assembly in the outer assembly, the inner assembly including a lower opening tool spaced from an upper opening tool;

activating the lower opening tool by moving the lower opening tool downhole past the activation profile and moving the lower opening tool uphole to engage with the activation profile to move a sleeve on the inner assembly that releases a collet of the lower opening tool; and activating the upper opening tool independent of the lower opening tool using the activation profile.

2. The method of claim 1, wherein each of the lower opening tool and the upper opening tool is activated by moving such tool to or past the activation profile in a downward direction or an upward direction.

3. The method of claim 1, wherein each of the lower opening tool and the upper opening tool remains deactivated until activated using the activation profile.

4. The method of claim 3, wherein activating the upper opening tool comprises:

moving the upper opening tool downhole to the activation profile;

moving the upper opening tool uphole to engage with the activation profile to move a sleeve on the inner assembly that releases a collet of the upper opening tool.

5. The method of claim 1, wherein the outer assembly further comprises a test device configured to engage with the lower opening tool to provide an indication that the lower opening tool is activated, the method further comprising:

manipulating the lower opening tool to engage with the test device to verify that the lower opening tool is activated.

6. The method of claim 5 further comprising engaging the upper opening tool with the test device to verify activation of the upper opening tool.

7. The method of claim 1, wherein the outer assembly includes a plug that prevents flow of a fluid through the outer assembly, wherein activating the upper opening tool comprises:

moving the plug; and activating the upper opening tool using the activation profile.

8. The method of claim 7 further comprising moving the upper opening tool to engage with a test device to verify activation of the upper opening tool.

9. The method of claim 7, wherein moving the plug comprises at least one of: moving the plug using the inner assembly; and breaking the plug using the inner assembly.

10. The method of claim 9, further comprising establishing a seal to prevent flow of the fluid past the outer assembly.

11. The method of claim 10, wherein establishing the seal comprises at least one of: reestablishing the plug it its original position; and establishing a seal between the outer assembly and the inner assembly.

12. The method of claim 1, wherein the outer assembly includes a plurality of sections, each section including a fluid flow device, the method further comprising:

pressure testing each of the sections prior to placing the inner assembly in the outer assembly.

13. A completion apparatus for use in a wellbore, comprising:

an outer assembly for placement in a wellbore and an inner assembly for placement in the outer assembly, wherein the outer assembly includes an activation profile, and the inner assembly includes a lower opening tool spaced from an upper opening tool, wherein the lower opening tool is activated from a deactivated position using the activation profile and the upper opening tool is activated from a deactivated position independently of the activation of the lower opening tool using the activation profile, wherein activating the lower opening tool comprises moving the lower opening tool downhole past the activation profile and moving the lower opening tool uphole to engage with the activation profile to move a sleeve on the inner assembly that releases a collet of the lower opening tool.

14. The completion apparatus of claim 13, wherein each of the lower opening tool and the upper opening tool is activated by moving such tool to or past the activation profile in a downward direction or an upward direction.

15. The completion apparatus of claim 14, wherein each of the lower opening tool and the upper opening tool remains deactivated until activated using the activation profile.

16. The completion apparatus of claim 13, wherein the upper opening tool activates when the upper opening tool is moved downward to engage with the activation profile.

17. The completion apparatus of claim 13, wherein the outer assembly further comprises a test device configured to engage with at least one of the lower opening tool and upper opening tool to provide an indication relating to the activation of the at least one of the lower opening tool and the upper opening tool.

18. The completion apparatus of claim 17, wherein moving the at least one of the lower opening tool and the upper opening tool to engage with the test device requires an increased force on the at least one of the lower opening tool and the upper opening tool to move past the test device.

19. The completion apparatus of claim 13, wherein the outer assembly includes a plug to prevent flow of a fluid through the outer assembly.

20. The completion apparatus of claim 19, wherein activating the upper opening tool comprises:

moving the plug; and activating the upper opening tool using the activation profile.

21. The completion apparatus of claim 20, wherein moving the plug comprises at least one of: moving the plug using the inner assembly; and breaking the plug using the inner assembly.

22. The completion apparatus of claim 13 further comprises a seal on one of the outer assembly or the inner assembly; and a slick line on the other of the outer assembly or the inner assembly to provide a seal between the inner assembly and the outer assembly.

* * * * *